US006623313B1

(12) United States Patent
Ichida et al.

(10) Patent No.: US 6,623,313 B1
(45) Date of Patent: Sep. 23, 2003

(54) CONNECTOR

(75) Inventors: Kiyofumi Ichida, Yokkaichi (JP); Yukihiro Fukatsu, Yokkaichi (JP); Toshikazu Sakurai, Yokkaichi (JP); Shinya Fujita, Yokkaichi (JP); Yuuichi Nankou, Yokkaichi (JP); Hajime Kawase, Yokkaichi (JP); Ryotaro Ishikawa, Yokkaichi (JP); Naoya Kurimoto, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/279,197

(22) Filed: Oct. 23, 2002

(30) Foreign Application Priority Data

| | | |
|---|---|---|
| Jun. 14, 2002 | (JP) | 2002-174860 |
| Jun. 6, 2002 | (JP) | 2002-166360 |
| Jun. 6, 2002 | (JP) | 2002-166364 |
| Jun. 6, 2002 | (JP) | 2002-166366 |
| Jun. 7, 2002 | (JP) | 2002-167929 |

(51) Int. Cl.[7] ..... H01R 13/40
(52) U.S. Cl. ..... 439/752.5; 439/595
(58) Field of Search ..... 439/595, 744, 439/752.5

(56) References Cited

U.S. PATENT DOCUMENTS

| | | | | |
|---|---|---|---|---|
| 4,127,314 A | | 11/1978 | Hasimoto | |
| 5,769,663 A | | 6/1998 | Kodama | |
| 5,859,534 A | * | 1/1999 | Saijo et al. | 324/538 |
| 5,944,557 A | * | 8/1999 | Fukuda | 439/595 |
| 6,276,964 B1 | * | 8/2001 | Shinozaki | 439/595 |
| 6,341,985 B2 | * | 1/2002 | Kodama | 439/595 |

FOREIGN PATENT DOCUMENTS

| | | |
|---|---|---|
| JP | 6-325814 | 11/1994 |

* cited by examiner

*Primary Examiner*—Lynn Feild
*Assistant Examiner*—Thanh-Tam Le
(74) *Attorney, Agent, or Firm*—Gerald E. Hespos; Anthony J Casella

(57) ABSTRACT

A connector has a housing (10) with cavities (11) into which terminal fittings (30) are insertable. Locks (13) in the housing (10) deform during insertion of the terminal fittings (30) into the cavities (11), but then resiliently restore to lock the terminal fittings (30) in the cavities (11). Lowered portions (12*a*) of a bottom wall (12) of the housing (10) face the locks (12) and prevent the locks (13) from being excessively deformed. The bottom surface of each lock (13) has a convex arcuate surface (13*c*) and each lowered portion (12*a*) of the bottom wall (12) has a recess (12*b*) substantially conforming to the convex arcuate surface (13*c*) to accommodate the convex arcuate surface (13*c*) when the lock (13) deforms.

14 Claims, 18 Drawing Sheets

CONNECTOR

BACKGROUND OF THE INVENTION

1. Field of the Invention

The present invention relates to a connector.

2. Description of the Related Art

Japanese Unexamined Patent Publication No. 6-325814 and FIG. 18 herein show a known connector with a housing 1 and terminal fittings 2. The housing 1 is formed with cavities 3, and the terminal fittings 2 are insertable into the cavities 3 from behind. The housing 1 also has deformation permitting spaces 4, and resiliently deformable locks 5 are provided between the cavities 3 and the deformation permitting spaces 4. Each lock 5 deforms into its deformation permitting space 4 as the terminal fitting 2 is inserted into the respective cavity 3. However, the locks 5 then restore resiliently to engage the respective terminal fitting 2. A preventing wall 6 is provided adjacent each the deformation permitting space 4 to engage the resiliently deformed lock 5 and to prevent the lock 5 from deforming excessively.

A demand exists to reduce the size of the connector. That demand could be met by reducing the height of the deformation permitting spaces 4, and thereby positioning the preventing walls 6 closer to the locks 5. The preventing walls 6 could be recessed to further reduce the height, and to enable the locks 5 to escape. However, such an arrangement thins the preventing walls 6 over the entire widths of the locks 5. The thin preventing walls 6 may not be sufficiently strong to prevent the excessive deformation of the locks 5. Therefore, there has been a limit to miniaturizing the connector.

The invention was developed in view of the above problem and an object thereof is to provide a connector suited to being miniaturized.

SUMMARY OF THE INVENTION

The invention is directed to a connector with a housing that has at least one cavity and a deformation permitting space in proximity to the cavity. A resilient deformable lock is formed in the housing and projects into the cavity at a location adjacent the deformation permitting space. The connector also has a terminal fitting that is insertable into the cavity. Insertion of the terminal fitting into the cavity causes the lock to deform into the deformation permitting space. However, the lock is restored resiliently to lock the terminal fitting in the cavity. A preventing portion is formed in the deformation permitting space at a location spaced from the lock and is configured to prevent excessive deformation of the lock. The lock has a convex tapered surface that faces the preventing portion and the preventing portion has an escaping recess for accommodating the deformed lock. The escaping recess substantially conforms to the surface of the lock that faces the preventing portion and preferably is narrower than the lock.

The tapered surface of the lock that faces the preventing portion may be pointed along part of the width of the lock and the escaping recess may have a shape substantially conforming to the pointed surface of the lock. As a result, the preventing portion is strong as compared, to a case where the escaping recess has a uniform depth across the entire width of the lock. Accordingly, the preventing portion prevents excessive deformation of the lock even if the connector is miniaturized. Accordingly, the connector is well suited to being miniaturized.

The surface of the lock that faces the preventing portion may be arcuate and may have a pointed portion in the widthwise center. Accordingly, the escaping recess may comprise an arcuate portion substantially conforming to the surface of the lock that faces the preventing portion. Thus, the preventing portion is thicker toward the opposite sides, and a thinner portion thereof at the widthwise center is supported firmly.

The surface of the lock that faces the preventing portion may comprise a substantially triangular portion with a point in the widthwise center. Accordingly, the escaping recess may comprise a triangular portion substantially alignable with and conforming to the surface of the lock that faces the preventing portion.

The surface of the lock that faces the preventing portion may comprise a substantially trapezoidal portion that narrows toward the widthwise center. Accordingly, the escaping recess may comprise a trapezoidal portion substantially alignable with and conforming to the surface of the lock that faces the preventing portion.

The surface of the lock that faces the preventing portion may be slanted and inclined up to the front.

The lock preferably comprises a first part with a projecting length that gradually increases toward the upper end and a second part with a substantially constant projecting length. The tapered portion may be on or near the first part of the lock.

At least one maneuverable recess may be provided at a portion of the lock laterally of the tapered portion for engagement by a disengagement jig.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A female connector according to the invention includes a female housing 10 and at least one female terminal fitting 30 inserted in the female housing 10, as shown in FIGS. 1 to 17. The female housing 10 can be connected to a male housing (not shown) so that the female terminal fittings 30 are electrically connected with male terminal fittings (not shown) in the mating male housing. In the following description, directions of inserting and withdrawing the female terminal fittings 30 into and from the female housing 10 are referred to as a forward direction and a backward direction, respectively, and reference is made to FIG. 8 concerning the vertical direction.

Figure 1:
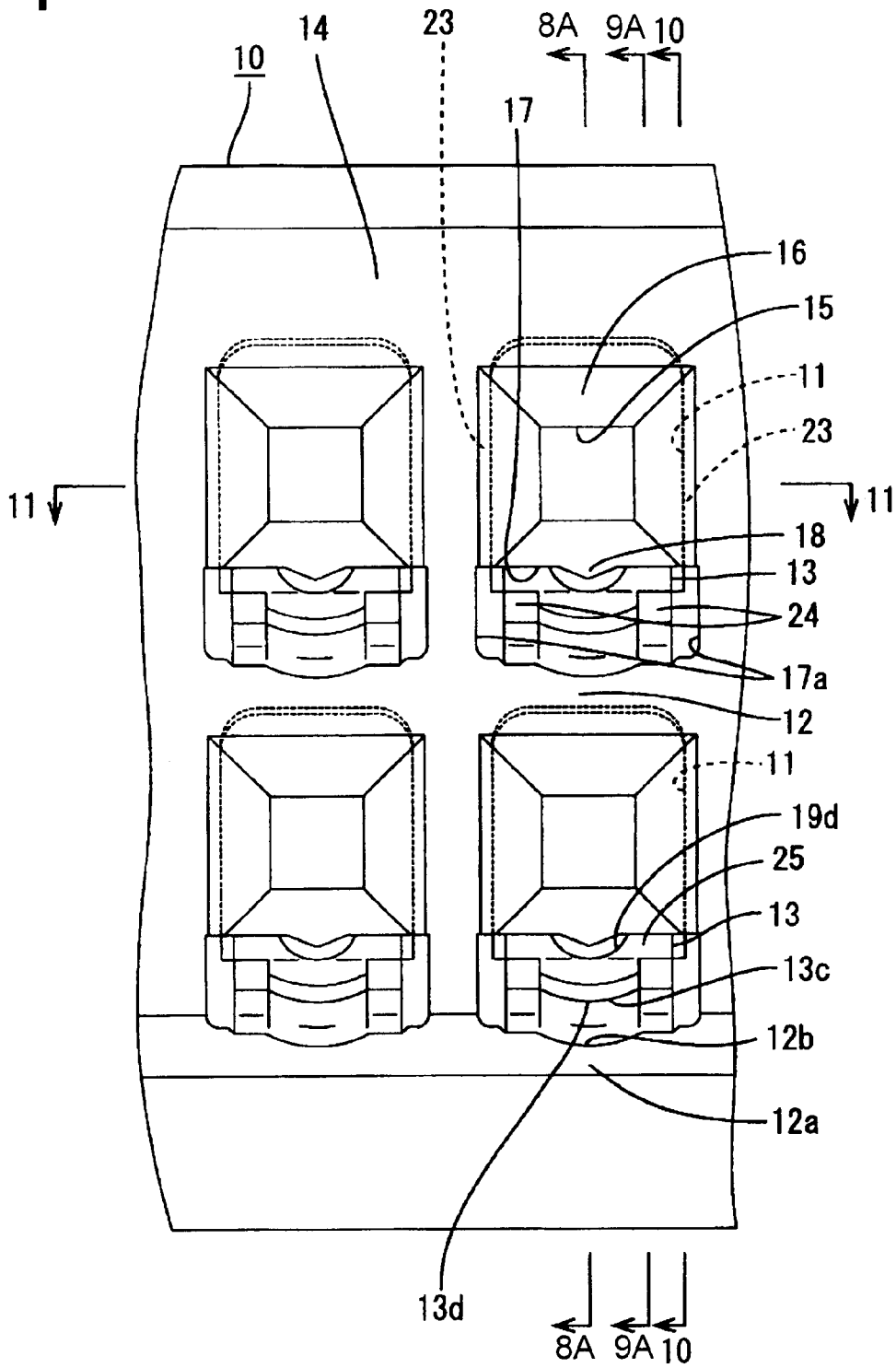
FIG. 1 is a front view of a female housing according to one embodiment of the invention.
Figure 8:
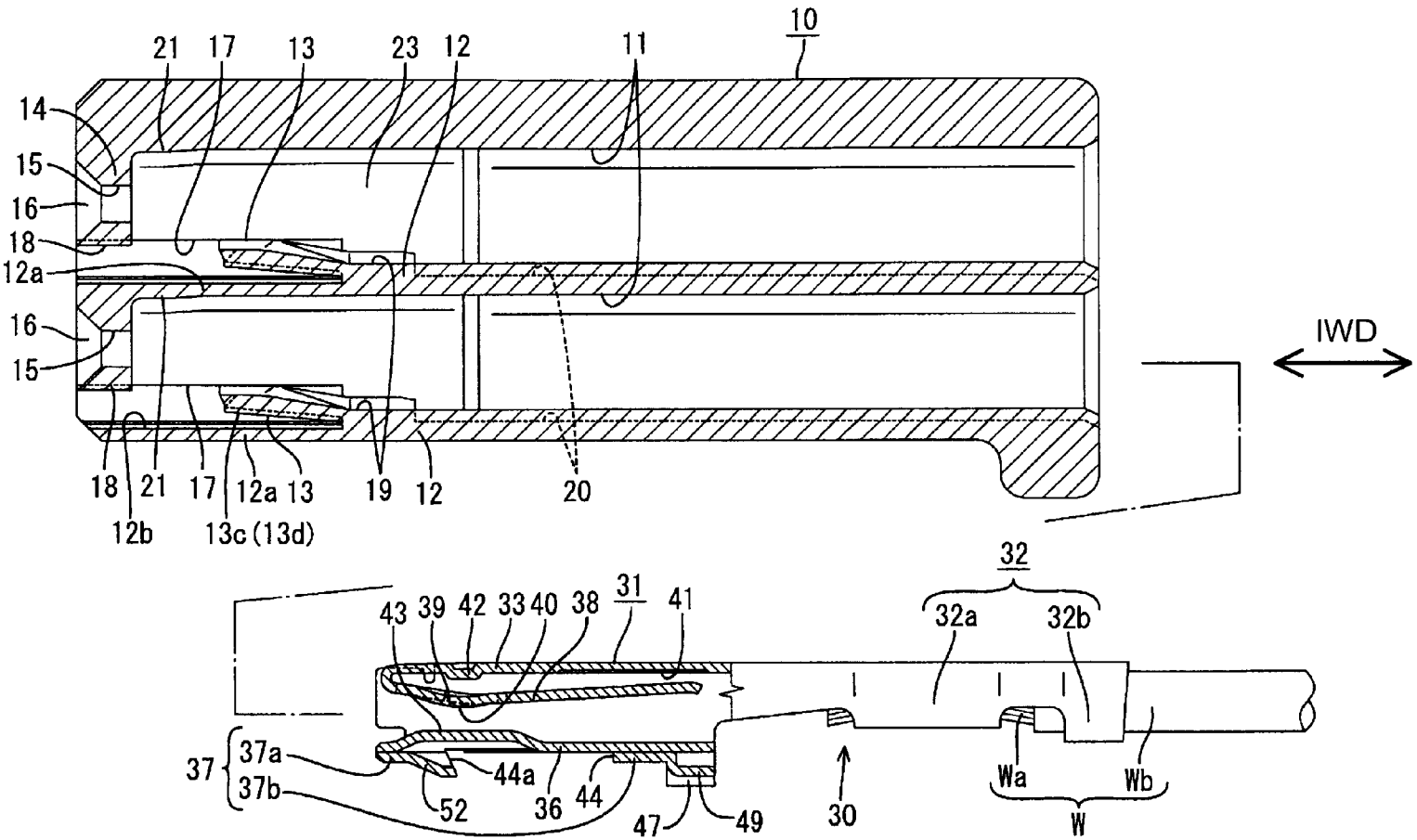
FIG. 8 is a cross-sectional view of the female housing taken along 8A—8A of FIG. 1 and a cross-sectional view of the female terminal fitting taken along 8B—8B of FIG. 4, and showing a state before the female terminal fitting is inserted into the female housing.

The female housing 10 is molded e.g. of a resin by front and rear molds that close and open substantially along forward and backward directions. Cavities 11 are arranged substantially side by side along the widthwise direction of the female housing 10 at each of two stages, as shown in FIGS. 1 and 8, and are configured for receiving the female terminal fittings 30 from behind. A lock 13 projects from a bottom wall 12 of each cavity 11 for locking the female terminal fitting 30 in the cavity 11. The female housing 10 also includes a front wall 14 for supporting the female terminal fitting 30 at a front-limit position. The front wall 14 of the female housing 10 has tab insertion holes 15 for permitting tabs of the male terminal fittings to be inserted into the cavities 11 from the front, and tapered guide surfaces 16 are formed at the front edges of the tab insertion holes 15, so that the tabs can be inserted smoothly. Mold removal holes 17 are provided in the front wall 14 of the female housing 10 below the tab insertion holes 15. The mold-removal holes 17 enable the front mold for forming the lock 13 to be removed when the female housing 10 is molded. A substantially triangular projection 18 projects down at the widthwise center of the upper end of each mold-removal hole 17 in the front wall 14, and the guide surface 16 is formed continuously at the projection 18.

About the front quarter of the bottom wall 12 of each cavity 11 has a lowered portion 12*a*, and the lock 13 is cantilevered forward from the resulting step. The lock 13 inclines up and gradually projects into the cavity 11. The portion of the lock 13 in the cavity 11 is pressed as the female terminal fitting 30 is inserted into the cavity 11. Thus, the lock 13 is deformed down in the deformation direction DD about a base end. During this deformation, the lock 13 retracts into a deformation permitting space in the lowered portion 12*a* of the bottom wall 12. The lowered portion 12*a* of the bottom wall 12 faces the lock 13 from below and prevents an excessive deformation of the lock 13 by engaging the lower surface of the lock 13 before the lock 13 deforms beyond its resiliency limit. The lock 13 is covered and protected by the lowered portion 12*a* of the bottom wall 12, which is connected with the front wall 14 over substantially the entire width without being exposed to the cavity 11 below or to the outside below the female housing 10.

Figure 2:
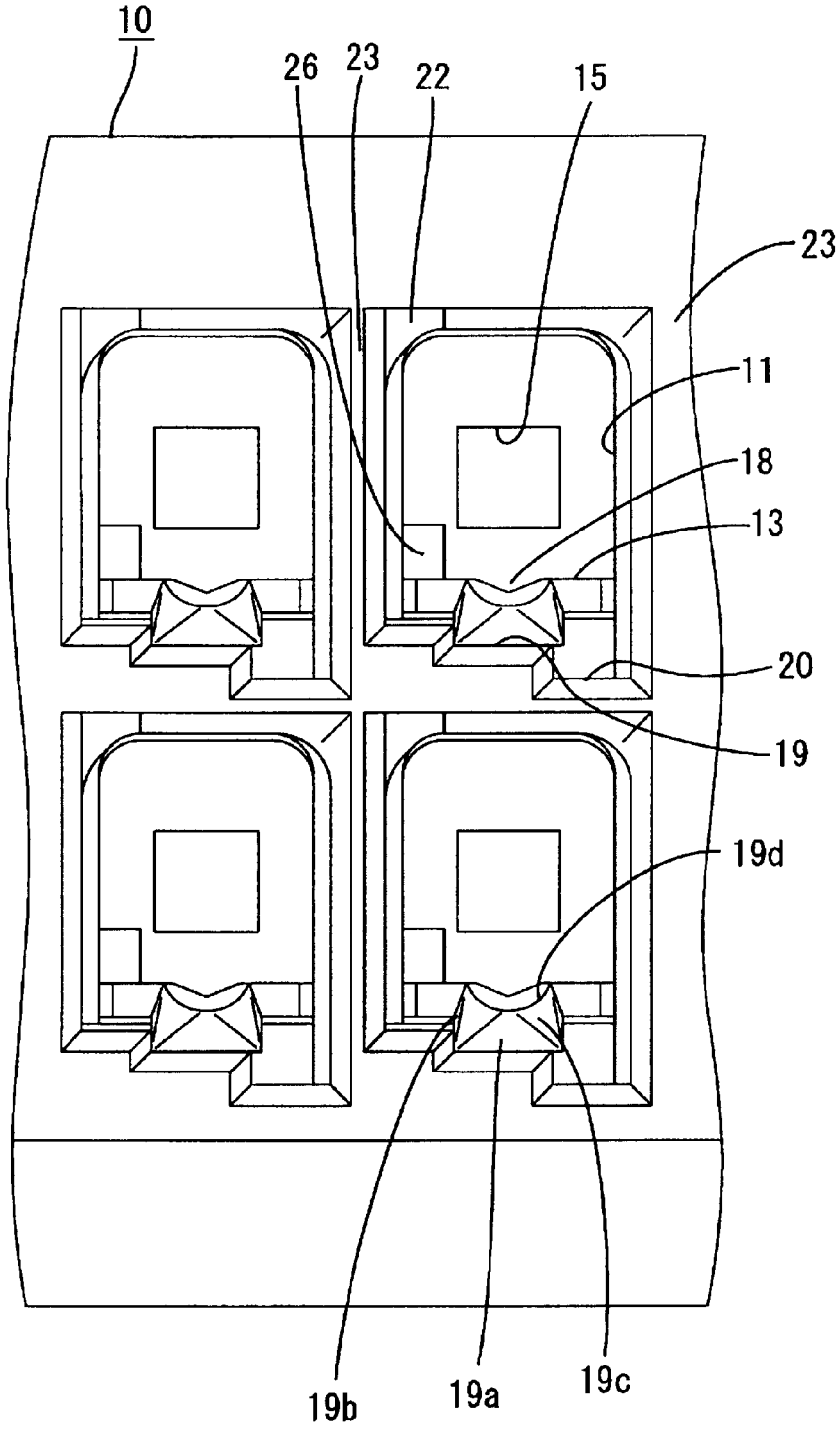
FIG. 2 is a rear view of the female housing.

A projection-inserting groove 19 is formed substantially in the widthwise center of the bottom wall 12, and a stabilizer-inserting groove 20 is formed at the right side of the projection-inserting groove 19 in FIG. 2. The stabilizer-inserting groove 20 is deeper than the projection-inserting groove 19. The projection-inserting groove 19 is substantially continuous with the lock 13, whereas the front end of the stabilizer-inserting groove 20 is slightly behind the lock 13. Accordingly, the bottom wall 12, the projection-inserting groove 19 and the stabilizer-insertion groove 20 define a stair shape in the widthwise direction (see FIG. 2).

Figure 11:
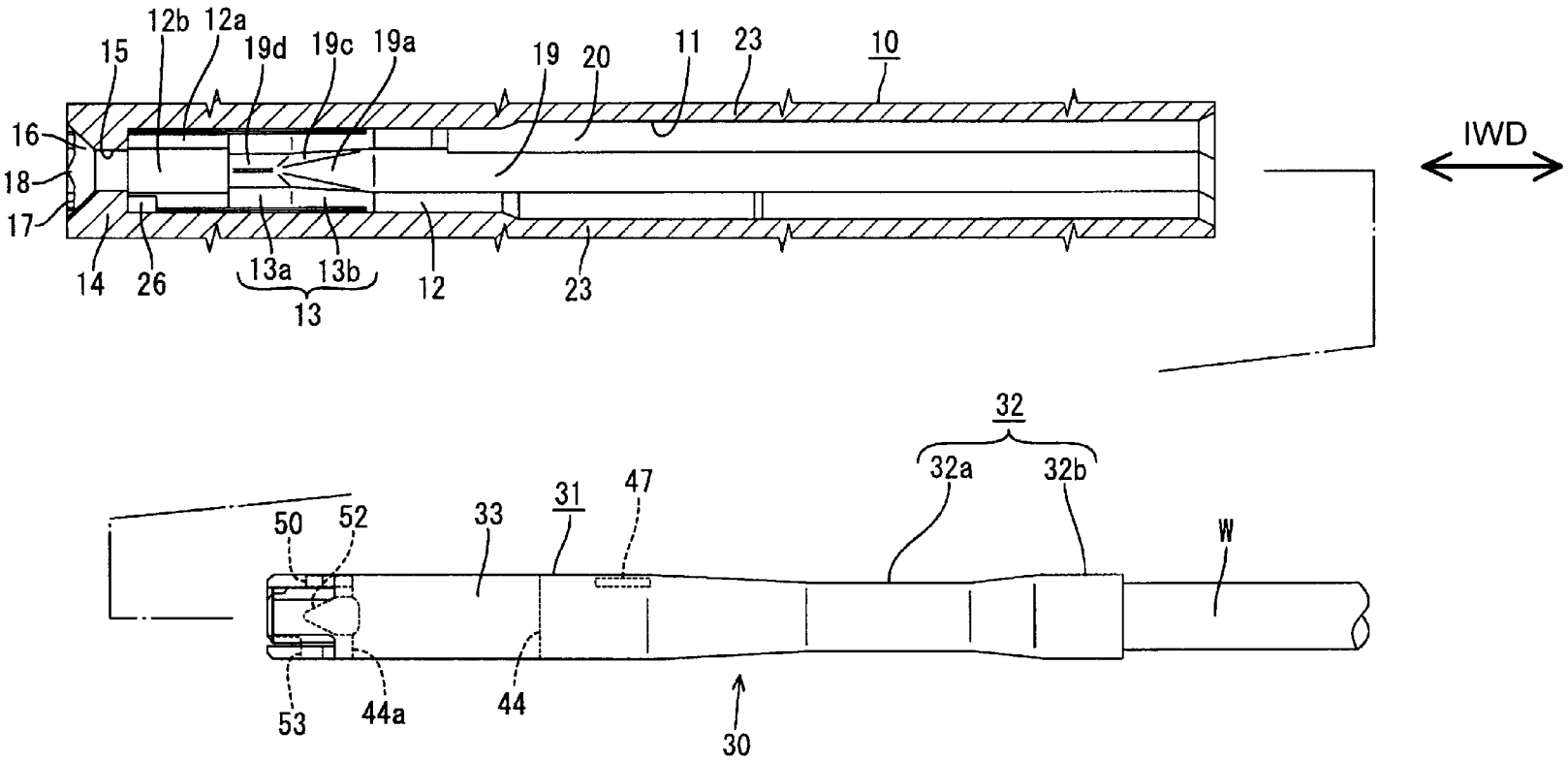
FIG. 11 is a cross-sectional view of the female housing taken along line 11—11 of FIG. 1 and a plan view of the female terminal fitting before the female terminal fitting is inserted into the female housing.

A projection 21 is provided at the front end of the upper surface of the cavity 11 and gradually projects down toward the lock 13 over the entire width of the cavity 11. The projection 21 pushes the front end of the female terminal fitting 30 toward the lock 13 as the female terminal fitting 30 is inserted into the cavity 11, and hence increases the depth of engagement with the lock 13. The peripheral edge of the rear end of the cavity 11 is inclined in and to the front over substantially the entire periphery to guide the female terminal fitting 30. A restriction 22 is at an upper-left position of the peripheral edge of the rear end of the cavity 11 in FIG. 2 and extends at an angle to the inserting and withdrawing directions IWD of the female terminal fitting 30. The restriction 22 contacts the stabilizer 47 when the female terminal fitting 30 is inserted improperly into the cavity 11, thereby hindering insertion. Further, opposite sidewalls 23 of the cavity 11 bulge so that a substantially front half is narrower than a substantially rear half as shown in FIG. 11.

Figure 3:
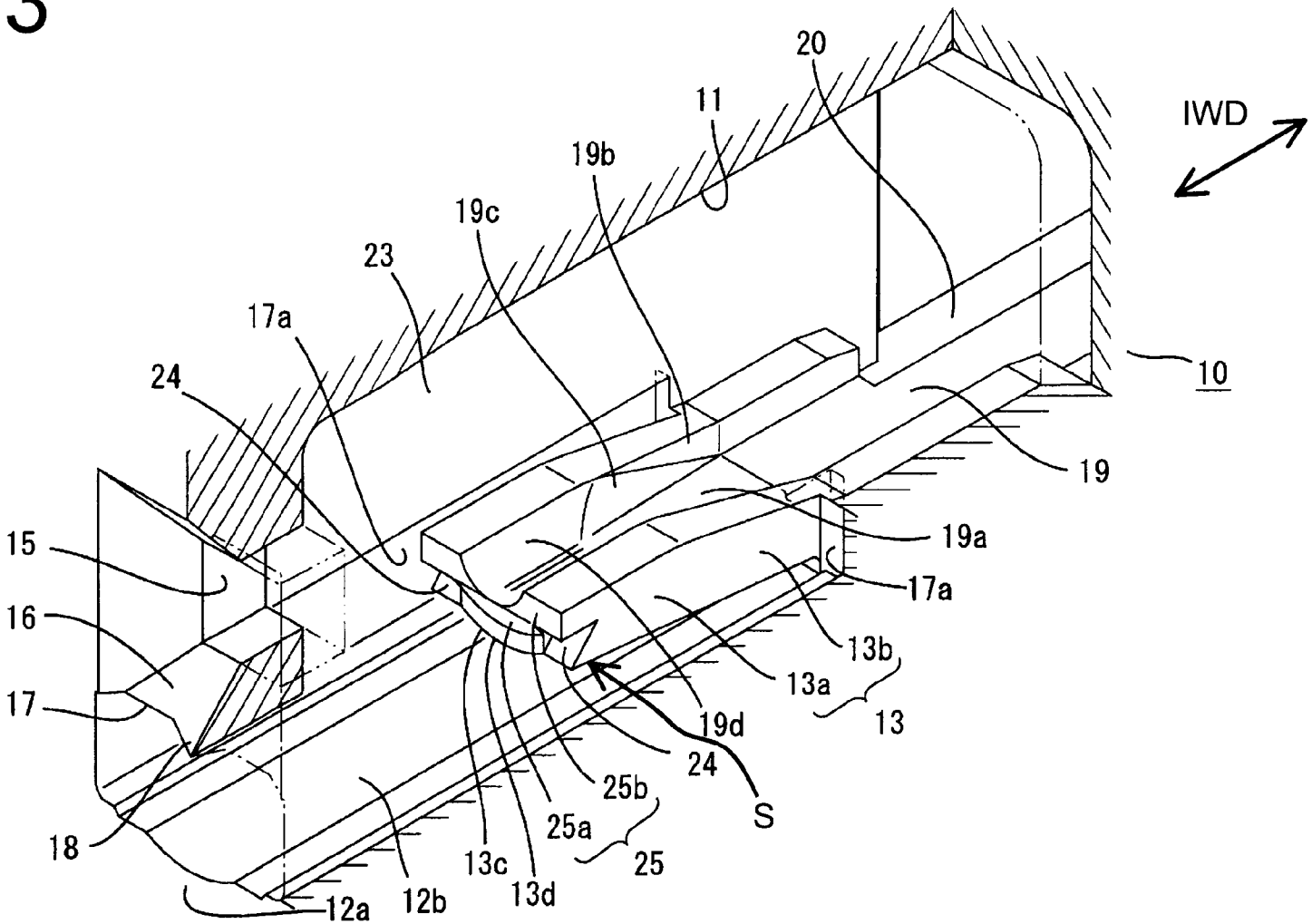
FIG. 3 is a perspective view partly in section of the female housing.

The lower surface of the lock 13 is slanted and inclines moderately up to the front over substantially the entire length of the lock 13, as shown in FIG. 3. The upper surface of the lock 13 is a slanted slightly steeper than the lower surface at a rear part 13*b* of the lock 13, but is substantially horizontal and parallel to the inserting and withdrawing directions IWD of the terminal fitting 30 at a front part 13*a* of the lock 13. The projection-inserting groove 19 is formed continuously along the upper surface of the lock 13 substantially at the widthwise center of the lock 13. The section of the projection-inserting groove 19 that extends along the rear part 13*b* of the lock 13 narrows gradually to the front. This narrowing section of the projection-inserting groove 19 is defined by a bottom surface 19*a*, a pair of planar vertical side surfaces 19*b* and a pair of inwardly slanted surfaces 19*c* that couple the opposite side surfaces 19*b* and the bottom surface 19*a*. The section of the projection-inserting groove 19 that extends along the front part 13*a* of the lock 13 defines an arcuate surface 19*d* that has a constant width over substantially the entire length. A convex arcuate surface 13*c* extends along the entire length of the widthwise center of the lower surface of the lock 13 and is curved more moderately than the arcuate surface 19*d* of the projection-introducing groove 19. A concave arcuate surface 12*b* is formed on the upper surface of the lowered portion 12*a* of the bottom wall 12. The convex arcuate surface 13*c* has a pointed, stepped or polygonal portion 13*d* that bulges out at the widthwise center, whereas the concave arcuate surface 12*b* substantially corresponds to the arcuate surface 13*c* of the lock 13. Thus, the lock 13 can escape into the deformation permitting space S when the lock 13 is deformed in the deformation direction DD. During this deformation, the lock 13 approaches the lowered portion 12*a* of the bottom wall 12 to such a degree that almost no clearance is present between the lock 13 and the lowered portion 12*a* of the bottom wall 12 (see FIG. 12). A part of the lowered portion 12*a* of the bottom wall 12 with the concave arcuate surface 12*b* is thinnest at its widthwise center and gradually becomes thicker toward the opposite sides. Thus, the arcuate surface 12*b* has a rounded or trapezoidal shape in cross-section.

The lock 13 has a constant width along its length and is slightly narrower than the cavity 11. The mold-removal hole 17 for the lock 13 is formed in the front wall 14 of the female housing 10 and is wider than the cavity 11. Accordingly, notches 17 are formed in the opposite sidewalls 23 of the cavity 11 and face the opposite sides of the lock 13. The thickness of the mold for molding the lock 13 can be made larger by the widths of the notches 17*a* and, thus, a necessary strength can be secured for the mold. Additionally, the width of the lock 13 is increased and the strength is enhanced.

Two forwardly open maneuverable recesses 24 are formed at the lower front of the lock 13 and extend along about ⅗ of the total height of the lock 13. The maneuverable recesses 24 are exposed forward to outside even if the female terminal fitting 30 is locked by the lock 13 (see FIG. 17), and can be pressed down in the deformation direction DD by a jig inserted through the mold-removal hole 17 from the front. Each maneuverable recess 24 is substantially triangular when the lock 13 is viewed sideways. The upper surface of the maneuverable recess 24 is substantially horizontal, whereas the lower surface thereof is inclined up and to the back (see FIG. 3).

A projection 25 projects forward over the entire width of the lower front end of the lock 13 and extends about ⅔ of the total height of the front end of the lock 13. The projection 25 interacts with the female terminal fitting 30. The projection 25 has a lower part 25*a* with projecting length that gradually increases toward the upper end and an upper part 25*b* above the maneuverable recesses 24 that has a constant projecting length. Thus, the front surface of the lower part 25*a* of the projection 25 slants up and to the front, whereas the front surface of the upper part 25*b* is substantially vertical.

Figure 10:
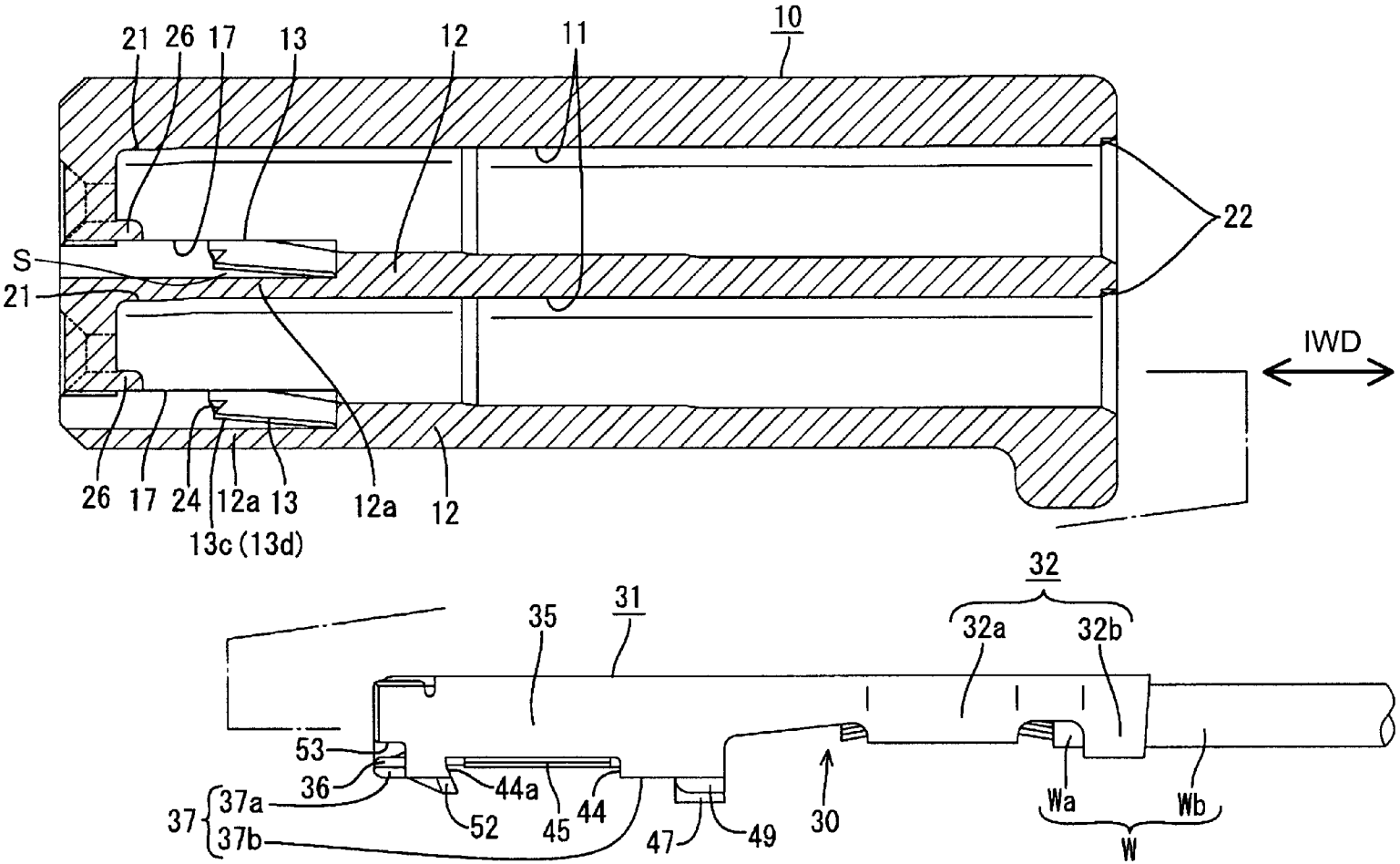
FIG. 10 is a cross-sectional view of the female housing taken along line 10—10 of FIG. 1 and a right side elevational view of the female terminal fitting before the female terminal fitting is inserted into the female housing.

A supporting projection 26 projects in at a corner of the front end of the cavity 11, as shown in FIGS. 2 and 10, and is fittable into a groove in the female terminal fitting 30 to prevent the female terminal fitting 30 from being inclined vertically. The supporting projection 26 is substantially block-shaped and is coupled to the front wall 14 of the female housing 10 and the left sidewall 23 of the cavity 11 for enhanced strength. Additionally, the supporting projection 26 is displaced up with respect to the lock 13 so that the lower surface of the supporting projection 26 faces the mold-removal hole 17.

Figure 5:
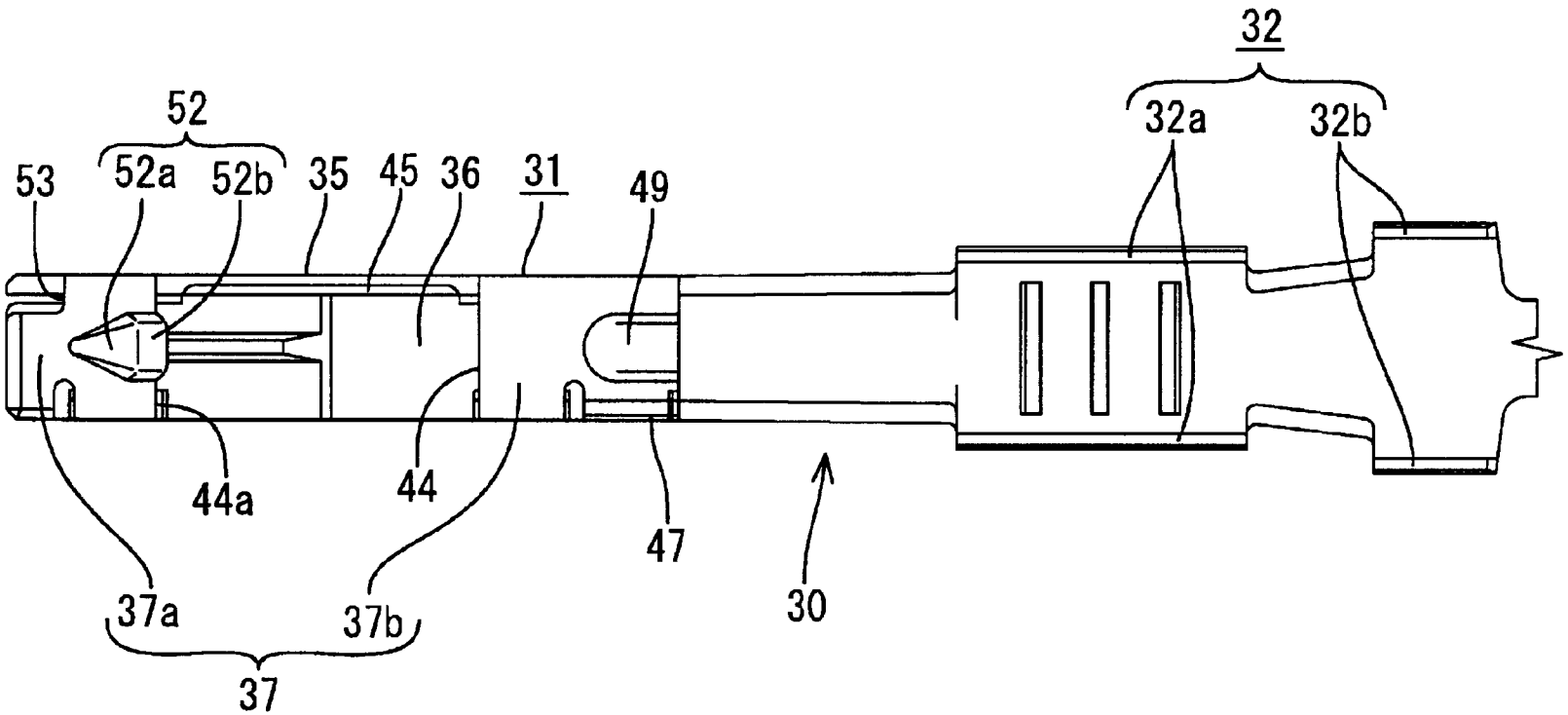
FIG. 5 is a bottom view of the female terminal fitting.

The female terminal fitting 30 is formed by embossing, folding and/or bending a metallic material that has been stamped or cut into a specified shape. The female terminal fitting 30, as shown in FIGS. 5 and 8, has a main body 31 substantially in the form of a box with open front and rear ends and a barrel 32 to be crimped, bent or folded into connection with an end of a wire W. The barrel 32 has a front pair of crimping pieces 32*a* for crimped connection with a core Wa of the wire W, and a rear pair of crimping pieces 32*b* for crimped connection with an insulated portion Wb of the wire W.

The main body 31 has a ceiling wall 33 that extends in forward and backward directions, left and right sidewalls 34, 35 that extend down from opposite lateral edges of the ceiling wall 33, a bottom wall 36 that extends from the projecting end of the left sidewall 34 of FIG. 4 to face the ceiling wall 33, and an outer wall 37 that extends from the projecting end of the right sidewall 34 of FIG. 4 to be placed below and outside the bottom wall 36.

The front end of the ceiling wall 33 is retracted back as compared to the front ends of the other walls 34, 35, 36 and 37, and a resilient contact piece 38 projects from this front end as shown in FIG. 8. The resilient contact piece 38 is formed from a tongue that extends from the front end of the ceiling wall 33 and is folded to face the ceiling wall 33 and the bottom wall 36. Thus, the resilient contact piece 38 is supported only at one end and has a substantially triangular shape. The resilient contact piece 38 has a forward-inclined portion and a backward-inclined portion that are provided one after the other behind a substantially U-shaped front fold. A long narrow elliptical bulge 39 is embossed to project toward the bottom wall 36 and extends from the forward-inclined portion to the backward-inclined portion. The peak of the bulge 39 defines a contact 40 for contacting the tab of the mating male terminal fitting. The resilient contact piece 38 deforms resiliently about the front fold and approaches the ceiling wall 33 as the tab of the male terminal fitting presses the contact 40. The end of the resilient contact piece 38 can be brought into contact with the inner surface of the ceiling wall 33 during the resilient deformation. A recess 41 in the ceiling wall 33 enlarges a degree of resilient deformation of the resilient contact piece 38 and prevents the deformed resilient contact piece 38 from a widthwise displacement.

An excessive deformation preventing projection 42 is embossed in the ceiling wall 33 and projects toward the contact 40. Engagement of the resilient contact piece 38 with the excessive deformation preventing projection 42 prevents deformation of the resilient contact piece 38 beyond its resiliency limit. Further, a receiving portion 43 bulges up from the bottom wall 36 at a position aligned with the bulge 39. Thus, the tab of the male terminal fitting can be squeezed between the receiving portion 43 and the resilient contact piece 38.

A cut-away 44 divides the outer wall 37 into front and rear portions 37*a* and 37*b*, as shown in FIGS. 5 and 8. The cut-away 44 is formed over substantially the entire width of the outer wall and is substantially at its longitudinal middle. The lock 13 can enter the cut-away portion 44 over its entire length when the female terminal fitting 30 is inserted into the cavity 11, and can engage a front cut end surface 44*a* of the cut-away portion 44. The front cut end surface 44*a* of the cut-away portion 44 is inclined up and to the back over its entire area. The cut-away portion 44 is slightly shorter than half the length of the outer wall 37 and extends up to the bottom end of the sidewall 35 at the upper side in FIG. 5. A bulging piece 45 extends from the projecting end of the bottom wall 36 and contacts the bottom end surface of the sidewall 35 to hold the bottom wall 36 substantially horizontally. The entire area of the bottom wall 36, except a contact portion of the bulging piece 45 with the sidewall 35, is slightly lower than this contact portion, thereby increasing a depth of engagement with the lock 13. The front portion 37*a* of the outer wall 37 is slightly shorter than the rear portion 37*b* in forward and backward directions.

Figure 6:
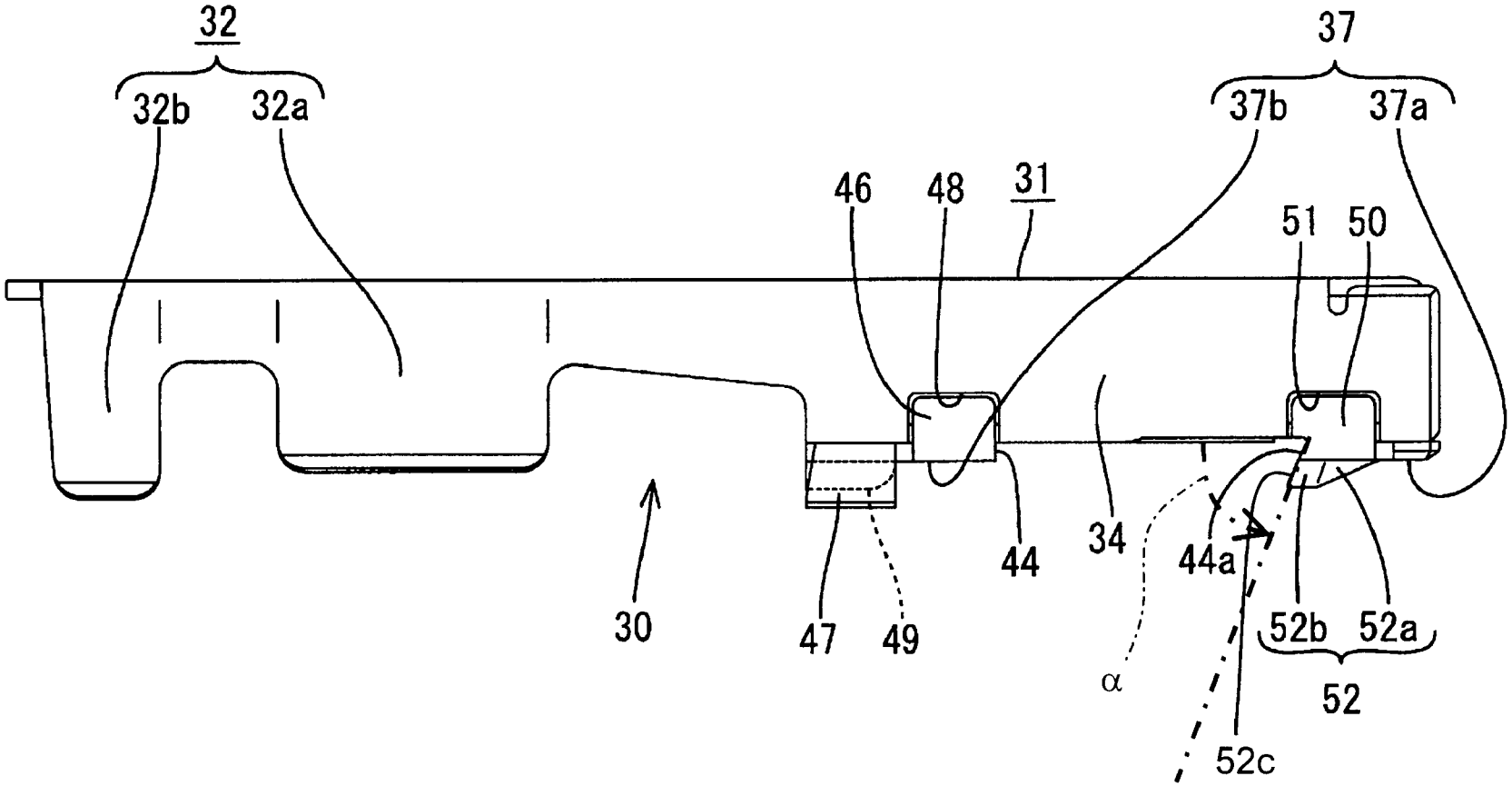
FIG. 6 is a left side view of the female terminal fitting.

A rear-portion holding piece 46 is bent up from the projecting end of the rear portion 37*b* of the outer wall 37, as shown in FIG. 6, and fits into a rear portion holding groove 48 to prevent loose forward and backward movement of the rear portion 37*b*. A stabilizer 47 is bent down from the projecting end of the rear portion 37*b* of the outer wall 37 and fits in the stabilizer-inserting groove 20 to guide the insertion of the female terminal fitting 30 into the cavity 11. The front end of the rear-portion holding piece 46 and the front end of the rear portion 37*b* are substantially aligned with each other. Similarly, the rear end of the stabilizer 47 and the rear end of the rear portion 37*b* are substantially aligned with each other. A projection 49 is embossed to project out at the widthwise center of the rear end of the rear portion 37*b* and has a length substantially equal to the length of the stabilizer 47. The projection 49 contacts the projection-inserting groove 19 when the female terminal fitting 30 is inserted into the cavity 11.

A front-portion holding piece 50 is bent up from the projecting end of the front portion 37*a* of the outer wall 37 and fits into a front-portion holding groove 51 in the side wall 34, as shown in FIG. 6, to prevent the front portion 37*a* from making loose forward and backward movements. The front-portion holding piece 50 projects more backward than the front portion 37*a* of the outer wall 37. The cut-away portion 44 extends into the base end of the front-portion holding piece 50, and the cut end surface 44*a* thereof is inclined in and up to the back as already described. A side end of the lock 13 is engageable with this cut end surface 44*a*.

Figure 4:
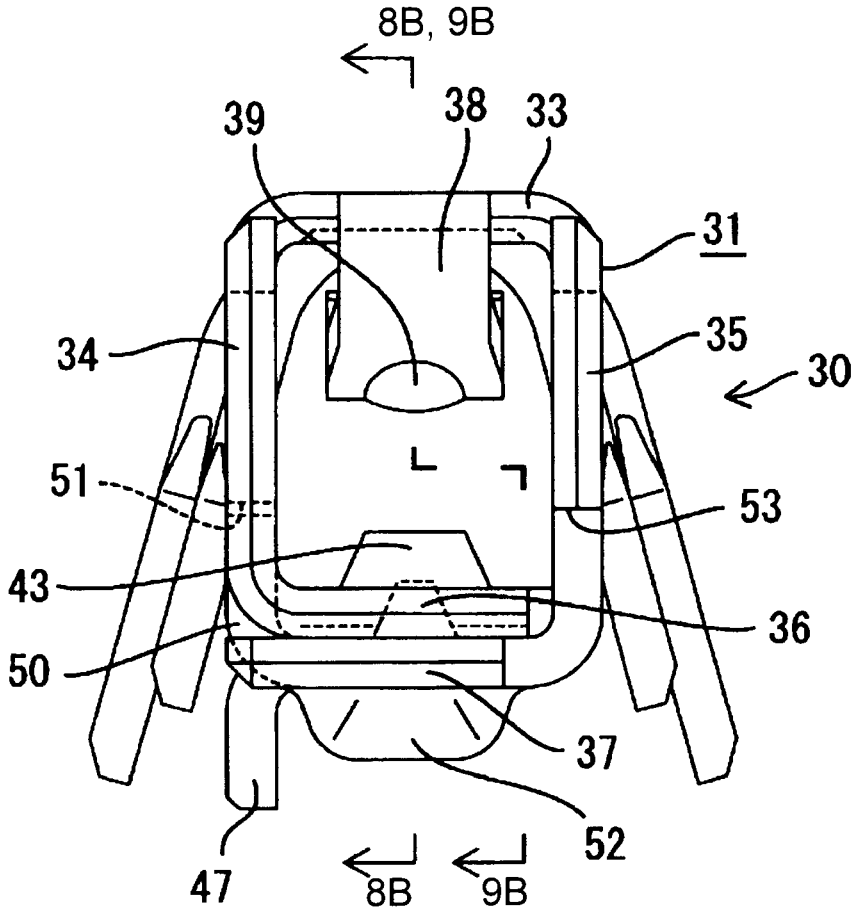
FIG. 4 is a front view of a female terminal fitting.
Figure 7:
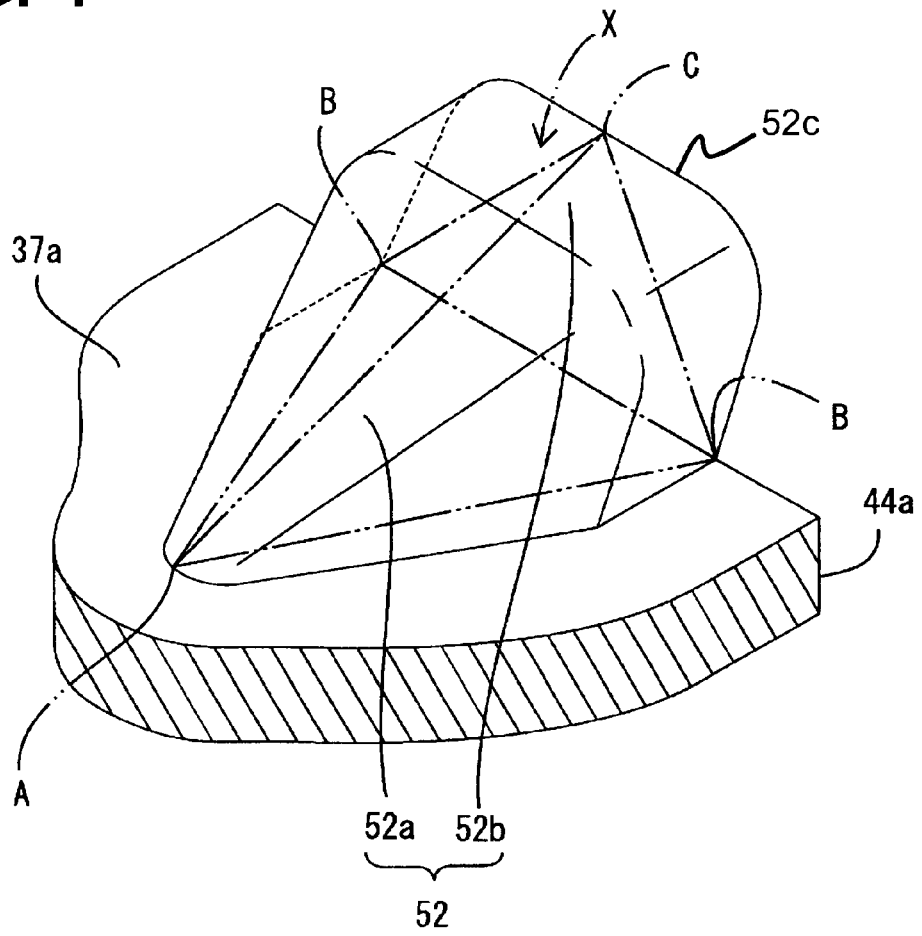
FIG. 7 is an enlarged perspective view showing a locking projection and an imaginary triangular pyramid.

A locking projection 52 is embossed out from the front portion 37*a* of the outer wall 37 at a position slightly to the left of center in FIG. 4 and adjacent the front cut end of the cut-away portion 44. The locking projection 52, as shown in FIGS. 5 to 7, is tapered so that the width and height of the locking projection 52 gradually decrease toward a vertex at the front end. More particularly, the locking projection 52 has a pyramid portion 52*a* formed by three slanted surfaces and a rectangular, parallelepipedic or trapezoidal tube portion 52*b* with a substantially constant width and height and formed by three sequentially connected side surfaces. The pyramid portion 52*a* of the locking projection 52 is tapered and has a slightly rounded front end, so that the locking projection 52 can be inserted smoothly along the projection-inserting groove 19 as the female terminal fitting 30 is inserted into the cavity 11. The rectangular tube portion 52*b* of the locking projection 52 overhangs back substantially along the inclination of the front cut end surface 44*a* of the cut-away portion 44 and projects more back towards the cut-away portion 44 than the front portion 37*a* of the outer wall 37. Thus, the locking projection 52 is substantially parallel to the undercut front cut end surface 44*a* and is inclined at an acute angle (X with respect to the insertion and withdrawal directions IWD and with respect to the plane defined by the cut-away portion 44.

Figure 9:
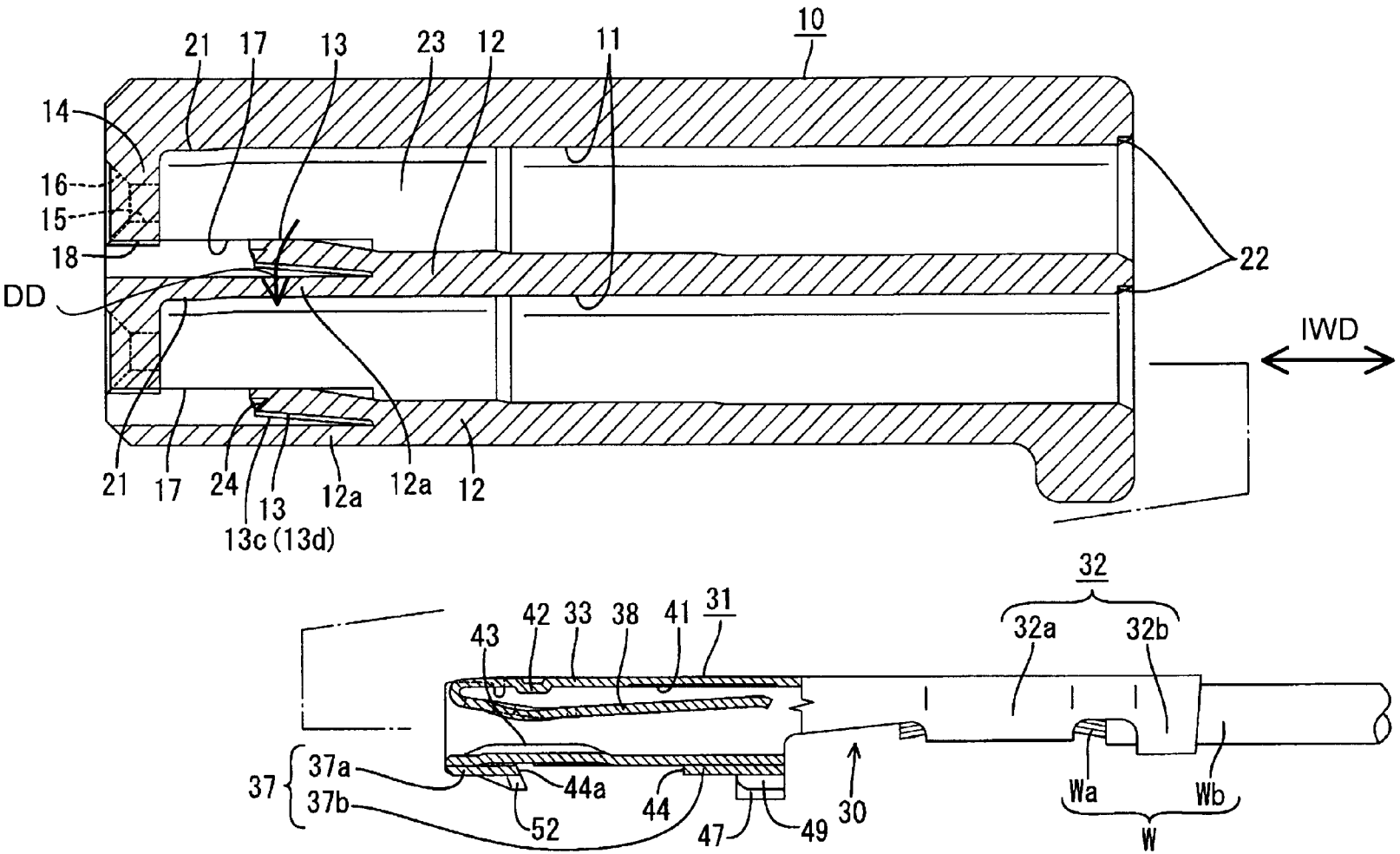
FIG. 9 is a cross-sectional view of the female housing taken along line 9A—9A of FIG. 1 and a cross-sectional view of the female terminal fitting taken along line 9B—9B of FIG. 4 and showing the state before the female terminal fitting is inserted into the female housing.

The locking projection 52 projects up to substantially the same height as the projection 49, and is insertable into the projection-inserting groove 19 of the cavity 11. The outward-projecting end of the rectangular tube portion 52*b* of the locking projection 52 is set to reach a part of the lock 13 below the projecting portion 25, thus ensuring a sufficient depth of engagement with the lock 13. The rear end 52*c* of the locking projection 52 is engageable with the lock 13 and is formed by the front cut end surface 44*a* of the cut-away portion 44, which inclines in and up to the back. The rear end surfaces of the front portion 37*a* of the outer wall 37 at opposite sides of the locking projection 52 also are formed by the inwardly and upwardly inclined front cut end surface 44*a* and are engageable with the lock 13, as shown in FIG. 9.

The locking projection 52 projects further out than an imaginary triangular pyramid X shown in FIG. 7. The imaginary triangular pyramid X has a vertex A at the front end of the locking projection 52 and is formed by connecting this vertex A with a pair of base end points B located at the rear edge of the front portion 37*a* of the outer wall 37 and an outward projecting end point C at substantially the middle of the rear end 52*c* of the locking projection 52. The outer surfaces of the locking projection 52 project more outward than any side of the imaginary triangular pyramid X (i.e. straight lines connecting the vertex A and the base end points B, straight line connecting the vertex A and the projecting end point C, straight lines connecting the base end points B and the projecting end point C). Thus, the inner volume of the locking projection 52 is larger than that of the imaginary triangular pyramid X.

A forwardly open fittable groove 53 is formed at a corner between the front portion 37*a* of the outer wall 37 and the right sidewall 35 of FIG. 4. Thus, the fittable groove 53 is at a side opposite the front-portion holding piece 50 with respect to widthwise direction. The supporting projection 26 at the front end of the cavity 11 is engageable with this fittable groove 53 as the female terminal fitting 30 is inserted into the cavity 11. Thus, the female terminal fitting 30 is supported so as not to move loosely in vertical directions that intersect the inserting and withdrawing directions IWD of the female terminal fitting 30.

The connector is assembled by crimping the barrel 32 of the female terminal fitting 30 into connection with the wire W, and then inserting the female terminal fitting 30 into the cavity 11 from behind, as shown in FIGS. 8 to 11. The female terminal fitting 30 cannot be inserted in an improper orientation because the stabilizer 47 would face up and would contact the restricting portion 22 at the peripheral edge of the rear end of the cavity 11. In this way, an upside-down insertion of the female terminal fitting 30 is prevented.

Figure 12:
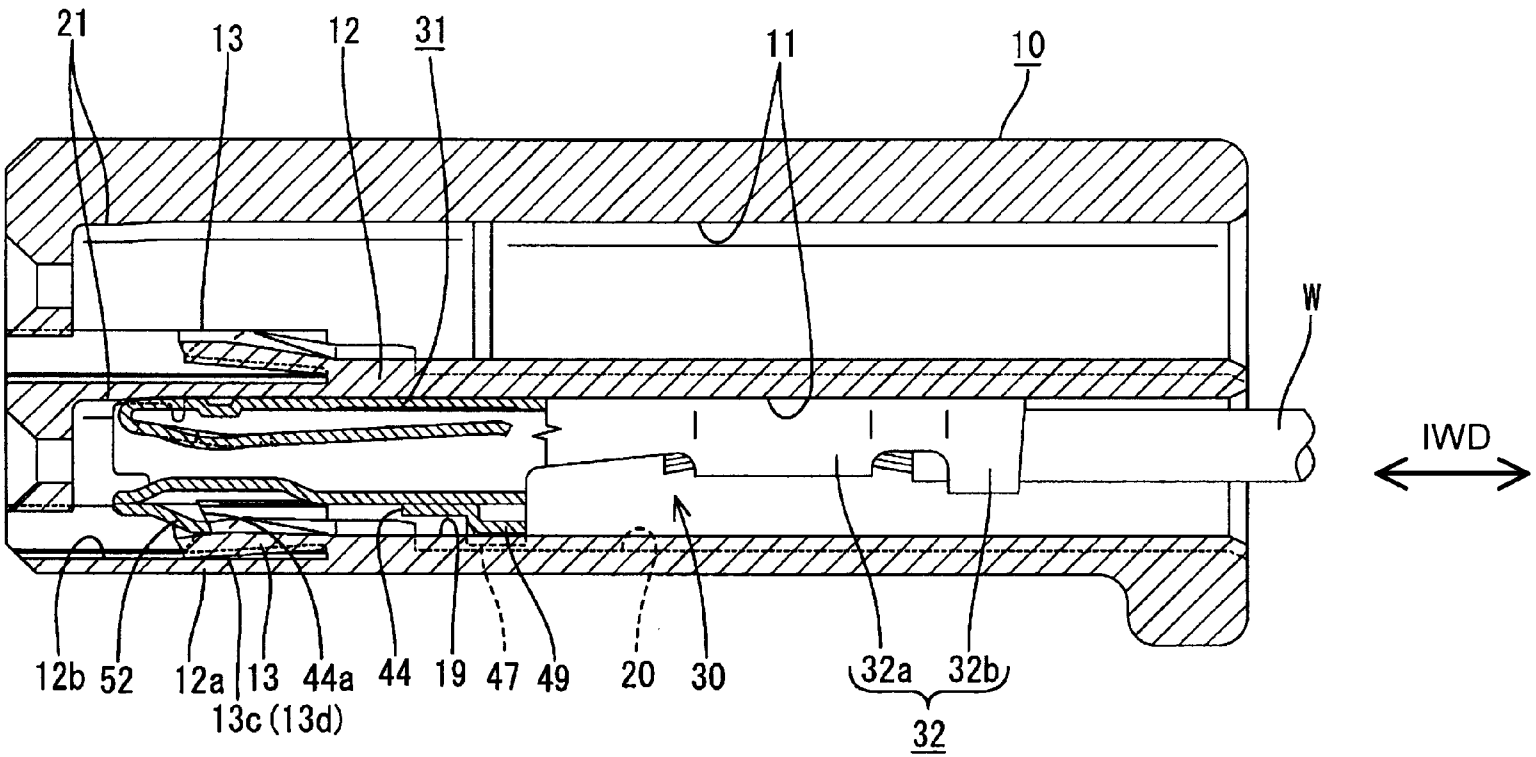
FIG. 12 is a cross-sectional view similar to FIG. 8, but showing an intermediate stage of insertion of the female terminal fitting into the female housing.
Figure 13:
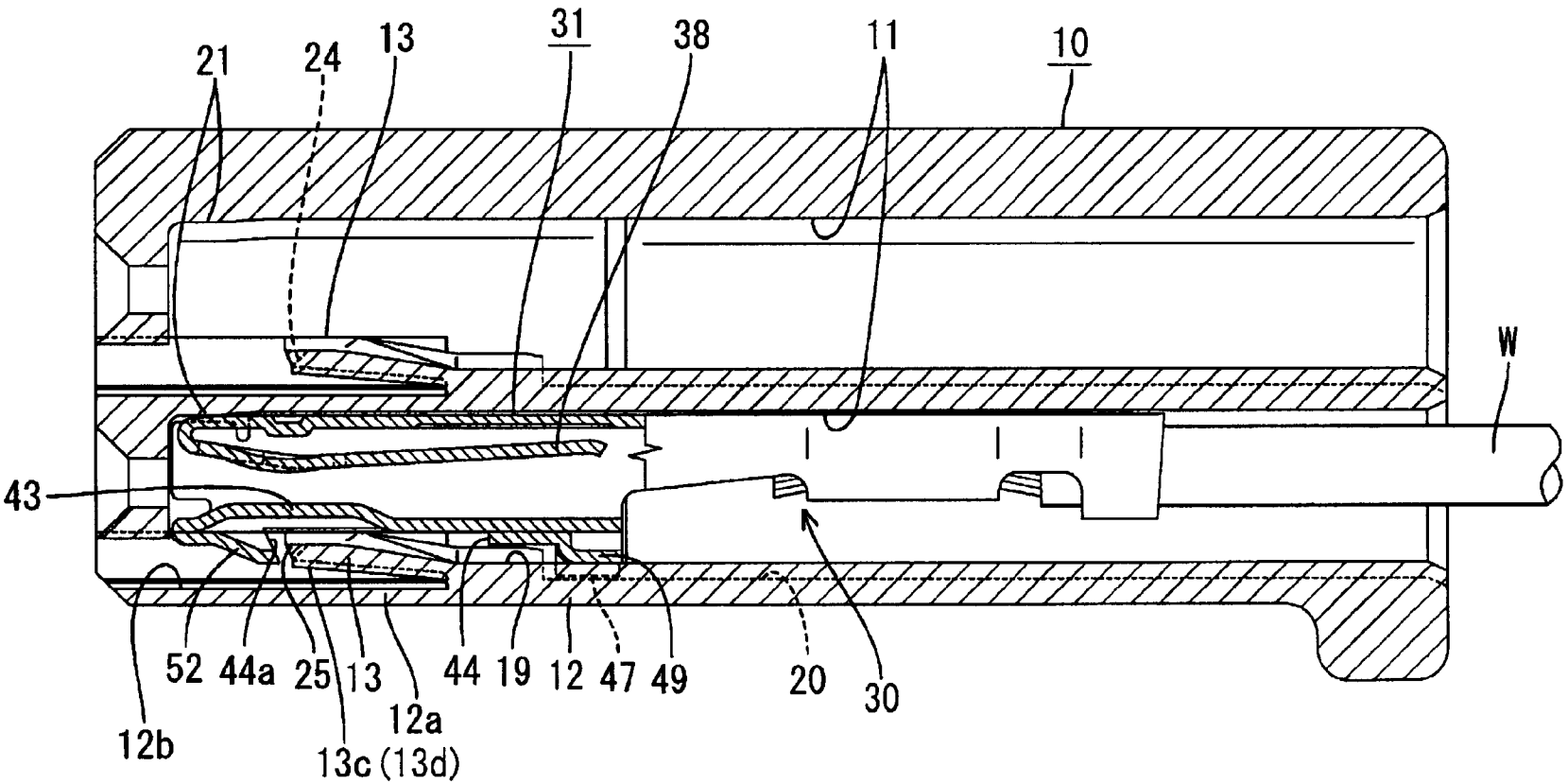
FIG. 13 is a cross-sectional view similar to FIG. 8, but showing a state where the female terminal fitting is inserted in the female housing.
Figure 14:
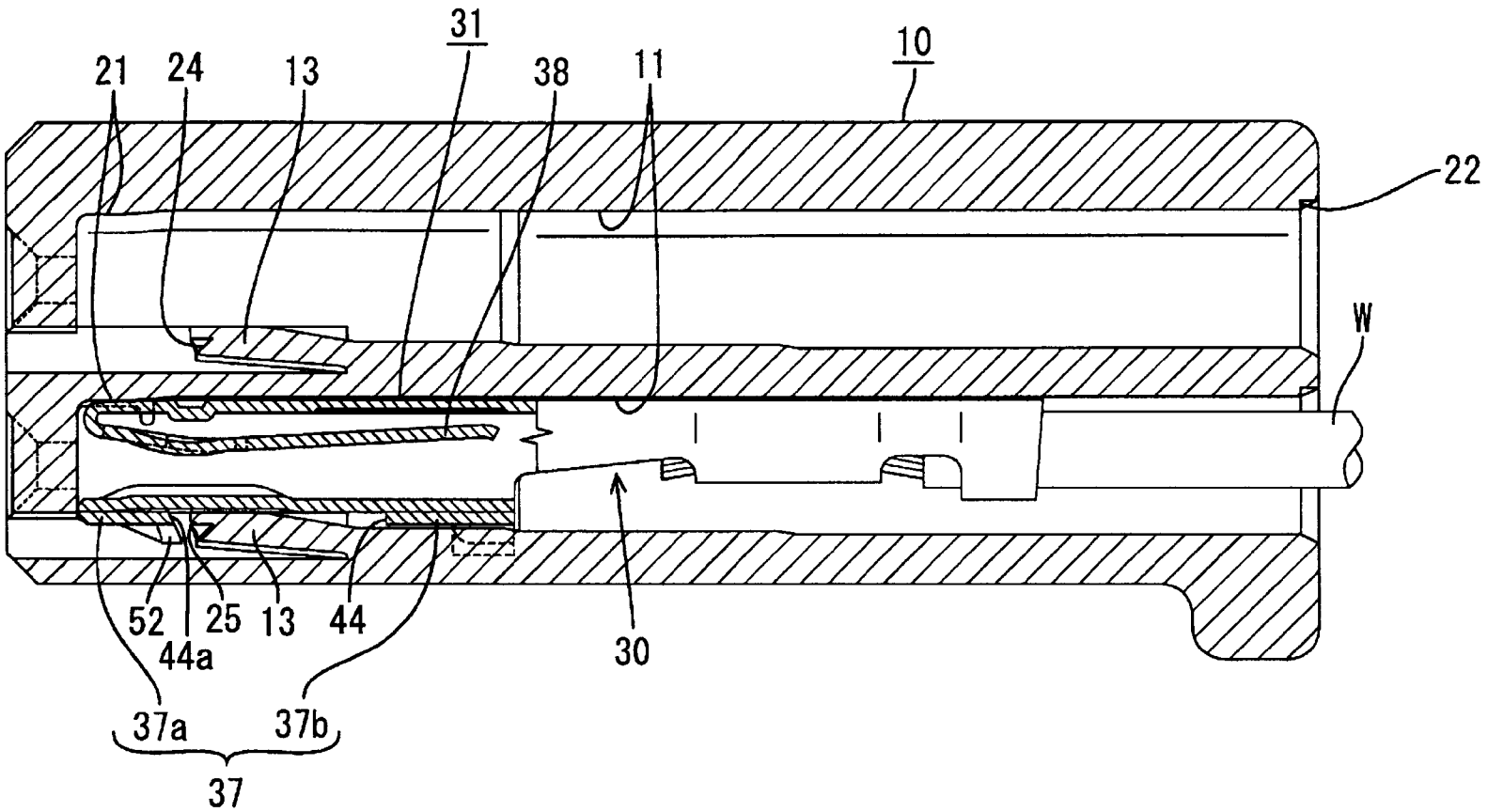
FIG. 14 is a cross-sectional view similar to FIG. 9, but showing the state where the female terminal fitting is inserted in the female housing.

Insertion of the female terminal fitting 30 into the cavity 11 introduces locking projection 52 into the projection-inserting groove 19. The projection 49 and the stabilizer 47 then are introduced into the projection-inserting groove 19 and the stabilizer-inserting groove 20 so that the properly oriented female terminal fitting 30 can be inserted smoothly into the cavity 11 without shaking along vertical and/or transverse directions. The locking projection 52 of the female terminal fitting 30 presses the lock 13 down, as shown in FIG. 12, when the female terminal fitting 30 is inserted to a specified depth. The lock 13 is deformed resiliently in the deforming direction DD to a maximum degree when the locking projection 52 presses the front part 13*a*. During this process, the locking projection 52 is inserted smoothly along the projection-inserting groove 19 and smoothly presses the lock 13 due to the pyramidal shape with a vertex at the front end.

Figure 15:
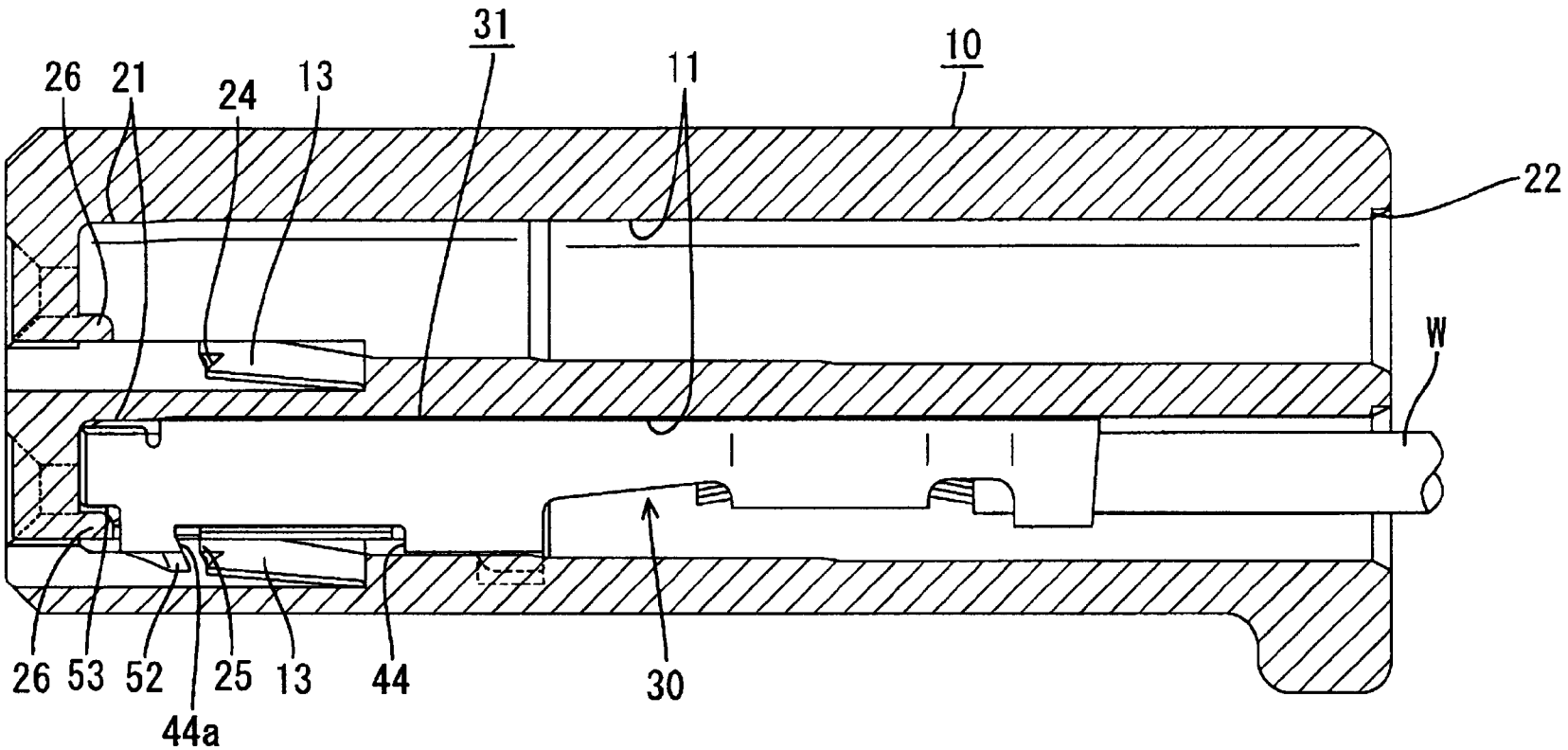
FIG. 15 is a cross-sectional view similar to FIG. 10, but showing the state where the female terminal fitting is inserted in the female housing.
Figure 16:
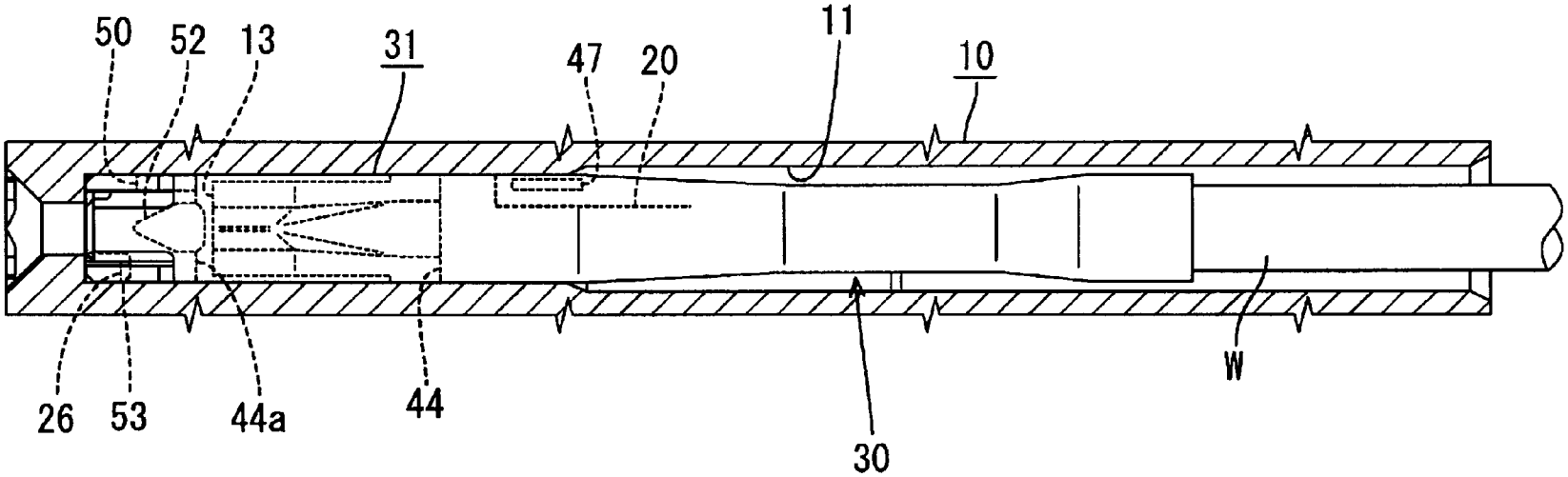
FIG. 16 is a cross-sectional view similar to FIG. 11, but showing the female terminal fitting inserted in the female housing.
Figure 17:
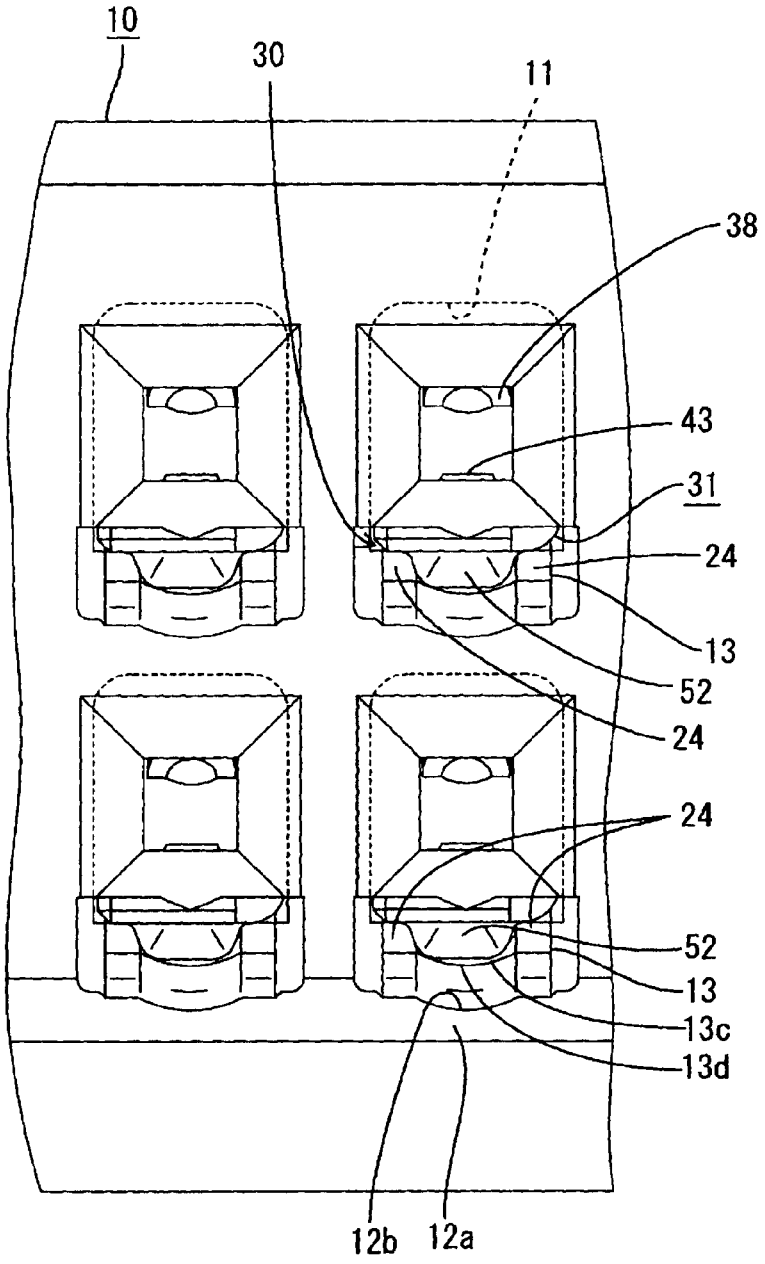
FIG. 17 is a front view showing a state where the female terminal fittings are inserted in the female housing.
Figure 18:
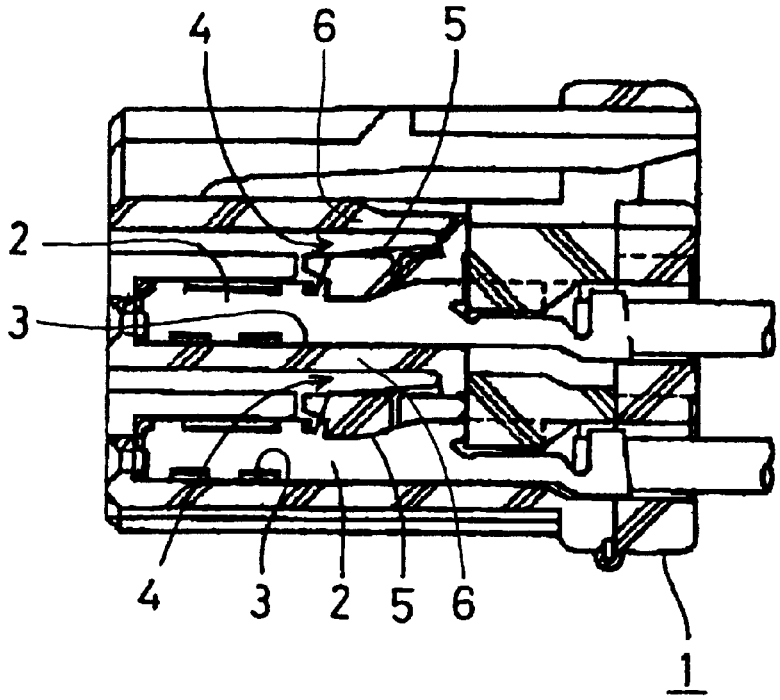
FIG. 18 PRIOR ART
FIG. 18 is a section of a prior art connector.

The locking projection 52 moves beyond the lock 13 as the female terminal fitting 30 is inserted to a proper depth in the cavity 11. Thus, the lock 13 is restored resiliently and enters the cut-away portion 44 to lock the female terminal fitting 30, as shown in FIGS. 13 to 16. More particularly, the projection 25 of the lock 13 projects along the inclination of the cut end surface 44*a* and enters the inside of the locking projection 52. The front end of the main body 31 is pushed down by the jutting portion 21 on the ceiling surface of the cavity 11 and is urged toward the lock 13. Consequently, the depth of engagement of the lock 13 with the female terminal fitting 30 is increased. Further, vertical inclination of the female terminal fitting 30 is prevented by the engagement of the supporting projection 26 with the fittable groove 53, as shown in FIG. 15. The locking projection 52 is displaced from both maneuverable recesses 24 of the lock 13 along widthwise direction and is exposed forward to outside together with the maneuverable recesses 24 as shown in FIG. 17. Further, the bottom end of the locking projection 52 is slightly above the arcuate surface 13*c* of the lock 13. In other words, the arcuate surface 13c is formed to extend substantially along the bottom end of an engaged area of the locking 13 with the female terminal fitting 30.

The front cut end surface 44*a* of the cut-away portion 44 is formed over substantially the entire width of the female terminal fitting 30 and reaches the front portion 37*a* of the outer wall 37 the locking projection 52 and the front-portion holding piece 50, as shown in FIGS. 13 to 16. Thus, the female terminal fitting 30 is held with a strong locking force and will not come out of the cavity 11. Further, the front cut end surface 44*a* of the cut-away portion 44 is inclined in and up to the back. Therefore, the locking force is even stronger.

A force could act on the female terminal fitting 30 via the wire W to pull the female terminal fitting 30 back from the above-described locked state. Hence, there is a possibility that the locking projection 52 of the female terminal fitting 30 will bite into the front end surface of the lock 13 and will scrape off enough of the lock 13 for the lock 13 to enter the inner space of the locking projection 52. However, the volume of the inner space of the locking projection 52 is larger than the inner volume of the imaginary triangular pyramid X shown in FIG. 7. Accordingly, a larger amount of the material of the lock 13 can enter the locking projection 52 at the time of biting. Thus, a force necessary to pull the female terminal fitting 30 back while causing the lock 13 to bite in the locking projection 52 is increased. Hence, the female terminal fitting 30 can be held strongly.

The female terminal fitting 30 may have to be detached from the female housing 10 for maintenance or other reason. In such a case, the disengagement jig is inserted into the mold-removal hole 17 from the front to press the maneuverable recesses 24 of the lock 13 down into the deformation permitting space S. As a result, the lock 13 is deformed in the deforming direction DD and disengages from the female terminal fitting 30. Simultaneously, the wire W is pulled back to withdraw the female terminal fitting 30. The disengagement jig could exert an excessive operation force on the lock 13 and could deform the lock 13 more than necessary. In such a case, the bottom surface including the arcuate surface 13*c* of the lock 13 engages the upper inwardly facing surface of the lowered portion 12*a* of the bottom wall 12 including the arcuate surface 12*b* before the lock 13 undergoes a deformation beyond its resiliency limit. As a result, the lock 13 is prevented from being plastically deformed and/or damaged.

As described above, the lock 13 has the arcuate bottom surface 13*c* with the pointed portion 13*d* along part of the width, and the bottom wall 12 has the lowered portion 12*a* with an arcuate surface 12*b* that substantially conforms to the arcuate surface 13*c* to prevent excessive deformation of the lock 13. Thus, the lowered portion 12*a* of the bottom wall 12 can be thicker and stronger than a lowered portion of a bottom wall that is of uniform depth across the entire width of the lock. Accordingly, even if the female connector is miniaturized, the excessive deformation of the lock 13 can be prevented without reducing the strength of the lowered portion 12*a* of the bottom wall 12, and the female connector is suited to being miniaturized.

The arcuate surface 13*c* of the lock 13 has the pointed portion 13*d* at its widthwise center, and the arcuate surface of the lowered portion 12*a* of the bottom wall 12 conforms to the arcuate surface 13*c* of the lock 13. Thus, the lowered portion 12*a* of the bottom wall 12 can be thicker toward the opposite sides of the arcuate surface 12*b*, and the thin center of the lowered portion 12*a* can be supported firmly to prevent excessive deformation of the lock 13.

The front portion 37*a* of the outer wall 37 of the female terminal fitting 30 has the locking projection 52 for extending the depth of engagement with the lock 13 and the upper surface of the lock 13 has the projection-inserting groove 19 for the escape of the locking projection 52. The projection-inserting groove 19 could weaken the lock 13. However, the bottom surface of the lock 13 bulges down to form the arcuate surface 13*c* and to enhance strength.

Additionally, the lowered portion 12*a* of the bottom wall 12 has the recessed arcuate surface 12*b* that substantially conforms to and accommodates the arcuate surface 13*c* of the lock 13. Hence, the lowered portion 12*a* of the bottom wall 12 is strong, as compared to a lowered surface that is recessed across the entire width of the bottom wall.

If no projection-inserting groove is formed in the upper surface of the lock, the lock remains strong, but the required deformation of the lock is larger, and the height of the female connector larger. To avoid this problem, the lowered portion of the bottom wall could be recessed over the entire width of the lock. However, this leads to a weak the bottom wall. The female connector of the subject invention can be miniaturized while maintaining a strong lock 13 and a strong lowered portion 12*a* of the bottom wall 12. Further, reducing the required deformation of the lock 13 reduces the force needed to insert and withdraw the female terminal fitting 30.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

An arcuate surface is on the bottom surface of the lock and a conforming arcuate surface is on the upper surface of the lowered portion of the bottom wall in the foregoing embodiment. However, it is not necessary to completely conform the shape of the bottom surface of the lock and the upper surface of the lowered portion. Embodiments in which these two arcuate surfaces have shapes slightly different from each other also are embraced by the invention. Additionally, the bottom surface of the lock and the upper surface of the lowered portion of the bottom wall can take any desired shape. For example, the bottom surface of the lock and the upper surface of the lowered portion of the bottom wall may have a triangular or trapezoidal shape when viewed from front or a transversely asymmetrical shape.

The locking projection is on the female terminal fitting and the projection-inserting groove for permitting the insertion of the locking projection is formed in the lock in the foregoing embodiment. However, these elements can be deleted without departing from the present invention.

Although a female connector is shown in the foregoing embodiment, the present invention is applicable to male connectors.

What is claimed is:

1. A connector having a housing (10) comprising:

at least one cavity (11) into which a terminal fitting (30) is insertable;

a resilient deformable lock (13) configured for deforming during insertion of the terminal fitting (30) into the cavity (11) and resiliently restoring after insertion of the terminal fitting (30) to lock the terminal fitting (30) in the cavity (11); and a preventing portion (12*a*) spaced from the lock (13) such that a deformation permitting space (S) is defined between lock (13) and the preventing portion (12*a*) for accommodating the deformation of the lock (13), the preventing portion (12*a*) disposed for engaging the lock (13) and preventing an excessive deformation of the lock (13);

wherein a surface (13*c*) of the lock (13) substantially facing the preventing portion (12*a*) has a tapered portion (13*c*) along at least part of the width thereof and the preventing portion (12*a*) has an escaping recess (12*b*) for accommodating the tapered portion (13*c*) of the lock (13) when the lock (13) is deformed, wherein the escaping recess (12*b*) and the surface (13*c*) of the lock (13) have substantially conforming shapes.

2. The connector of claim 1, wherein the surface (13*c*) of the lock (13) facing the preventing portion (12*a*) has an arcuate shape with a pointed portion (13*d*) in a widthwise center, and the escaping recess (12*b*) has an arcuate shape (12*b*) substantially conforming to the surface (13*c*) of the lock (13).

3. The connector of claim 1, wherein the surface (13*c*) of the lock (13) facing the preventing portion (12*a*) has a substantially triangular shape with a point in a widthwise center, and the escaping recess (12*b*) has a triangular shape substantially aligned with the surface (13*c*) of the lock (13).

4. The connector of claim 1, wherein the surface (13*c*) of the lock (13) facing the preventing portion (12*a*) has a substantially trapezoidal shape with a blunt point in a widthwise center, and the escaping recess (12*b*) has a trapezoidal shape substantially aligned with the surface (13*c*) of the lock (13).

5. The connector of claim 1, wherein the surface (13*c*) of the lock (13) is slanted away from the preventing portion (12*a*).

6. The connector of claim 1, wherein the lock (13) comprises a first part (25*a*) with a gradually increasing projecting and a second part (25*b*) with a substantially constant projecting length.

7. The connector of claim 6, wherein the tapered portion (13*c*) is on the first part (25*a*) of the lock (13).

8. The connector of claim 1, wherein the lock has at least one maneuverable recess (24) laterally of the tapered portion (13*c*) for engagement by a disengaging jig.

9. The connector of claim 1, wherein the recess (12*b*) in the preventing portion (12*a*) is narrower than the lock (13).

10. A connector having a housing (10) with opposite front and rear ends and defining a longitudinal direction extending between the ends, the housing (10) comprising:

a cavity (11) extending through the housing (10) from the front end to the rear end;

a resilient deformable lock (13) projecting into the cavity (11), the lock (13) having a longitudinally extending groove (19) in a surface of the lock (13) facing into the cavity (11) and a longitudinally extending convex projection (13*c*) on a surface of the lock (13) opposite the groove (19); and a preventing portion (12*a*) spaced from the surface of the lock (13) having the convex projection (13*c*) such that a deformation permitting space (S) is defined between lock (13) and the preventing portion (12*a*) for accommodating deformation of the lock (13), the preventing portion (12*a*) having a longitudinally extending escaping recess (12*b*) substantially aligned with the convex projection (13*c*) and having a shape substantially conforming to the convex projection (13*c*) for accommodating the convex portion (13*c*) of the lock (13) when the lock (13) is deformed.

11. The connector of claim 10, wherein the convex projection (13*c*) has an arcuate cross-sectional shape.

12. The connector of claim 10, wherein the convex projection (13*c*) has a triangular cross-sectional shape.

13. The connector of claim 10, wherein the convex projection (13*c*) has a trapezoidal cross-sectional shape.

14. The connector of claim 10, wherein the recess (12*b*) in the preventing portion (12*a*) is narrower than the lock (13).

* * * * *